United States Patent [19]

Drury

[11] 4,097,344

[45] Jun. 27, 1978

[54] ELECTROCHEMICAL COUPLING OF PERFLUOROALKYL IODIDES

[75] Inventor: Robert Finley Drury, Roosevelt, N.J.

[73] Assignee: E. I. Du Pont de Nemours and Company, Wilmington, Del.

[21] Appl. No.: 700,967

[22] Filed: Jun. 29, 1976

[51] Int. Cl.[2] ..... C25B 3/02

[52] U.S. Cl. ..... 204/59 R; 204/72; 204/78; 204/79

[58] Field of Search ..... 204/59 R, 72, 79, 78, 204/80

[56] References Cited

U.S. PATENT DOCUMENTS

| | | | |
|---|---|---|---|
| 3,876,514 | 4/1975 | Baizer | 204/59 R |
| 3,879,271 | 4/1975 | Nohe et al. | 204/72 |

*Primary Examiner*—F.C. Edmundson

[57] ABSTRACT

A process of anodically coupling compounds of the formula $R^1_fR^2_fCFI$ where $R^1_f$ and $R^2_f$ are each independently fluorine or a perfluoroalkyl radical containing from 4 to 40 carbon atoms in a liquid carboxylic acid in the presence of a small amount of carboxylate ion. The process generally is carried out at from 25° to 150° C. Generally the concentration of $R^1_fR^2_fCFI$ is from 5 to 40 weight percent of the reaction mixture.

10 Claims, No Drawings

ELECTROCHEMICAL COUPLING OF PERFLUOROALKYL IODIDES

BACKGROUND OF THE INVENTION

1. Field of the Invention

This invention relates to a process for anodic coupling of perfluoroalkyl iodides to fluorocarbons.

2. Relation to the Prior Art

Coupling of halogenated organic compounds is known. U.S. Pat. No. 3,317,618, to Haszeldine describes a process of coupling halogenated organic compounds including perfluoroalkyl chlorides, bromides, and iodides by a process in which the compound is subjected to energization to raise its energy level sufficiently to cause fission of the carbon-halogen bond with formation of a free alkyl radical. Forms of energization include heat, molecular oxygen, ultraviolet, infrared, X, $\gamma$, or high energy electron radiation, preferably in the presence of a halogen acceptor. Bissell, J. Chem. Eng. Data, 10, 382 (1965), describes the coupling of fluoroalkyl iodides to fluorocarbons by irradiation with ultraviolet light in the presence of mercury.

These art processes suffer from the disadvantage that they require rigorous conditions to bring about the homolytic cleavage of the carbon-iodine bond, and require iodine scavengers to be present in order to go to a practical degree of completion. In addition, they generate toxic metal salts as by-products which present disposal problems and require additional treatment to recover iodine values in usable form.

SUMMARY OF THE INVENTION

It has now been discovered that primary or secondary perfluoroalkyl iodides of the structure $$R_f^1R_f^2CFI$$

where $R_f^1$ and $R_f^2$ are each independently fluorine or a perfluoroalkyl radical, may be anodically coupled in high yield to fluorocarbons in the presence of an aliphatic carboxylic acid as co-reactant.

Preferred as starting materials are compounds of structure I which contain a minimum of 4 carbons and a maximum of 40 carbon atoms. Particularly preferred are perfluoroalkyl iodides which contain 5–8 carbon atoms since they give the highest yields of coupled products at high current efficiencies.

Preferred as co-reactants are straight chain aliphatic carboxylic acids or their perfluorinated analogs which contain 2–5 carbon atoms. Acetic acid is most preferred because of its low cost and the relatively high volatility of methyl iodide, formed as a product from this co-reactant.

The term "perfluoroalkyl" refers to a group derived from a saturated aliphatic fluorocarbon, i.e., a hydrocarbon in which all hydrogen atoms have been replaced by fluorine atoms, by removal of a fluorine atom.

DETAILED DESCRIPTION OF THE INVENTION

The anodic coupling process of the invention can be carried out under mild conditions of temperature and pressure. The reaction probably proceeds by iodine abstraction from the perfluoroalkyl iodide by alkyl radicals, followed by combination of two perfluoroalkyl radicals to give the desired fluorocarbon product. The alkyl radicals are in turn formed by an anodic oxidation process in which a carboxylate is the electroactive species. Such anodic oxidation processes, which in the absence of perfluoroalkyl iodides lead to coupled hydrocarbon products, are generally classified as Kolbe electrosyntheses. A recent review of Kolbe electrosynthesis reactions by Eberson can be found in Organic Electrochemistry edited by M. M. Baizer, Marcel Dekker, Inc., New York, 1973, p. 469.

Hence the overall process of the invention may be represented by equation (1).

$$2R_f^1R_f^2CFI + 2R^3CO_2H \rightarrow R_f^1R_f^2CFCFR_f^1R_f^2 + 2R^3I + 2CO_2 + H_2 \quad (1)$$

It is not necessary that the process be limited to anodic coupling of a single perfluoroalkyl iodide. Thus when the coupling reaction is applied to a mixture of two or more iodides a mixture of all possible fluorocarbons is obtained. Thus if the starting material is a mixture of $R_f^4I$ and $R_f^5I$, products $R_f^4$-$R_f^4$, $R_f^4$-$R_f^5$ and $R_f^5$-$R_f^5$ would be formed. Coupling of mixtures of perfluoroalkyl iodides is further illustrated by specific examples 8, 11 and 15 below.

The aliphatic carboxylic acid co-reactant can also be employed as a solvent for the anodic coupling reaction and this is the preferred mode of operation. Alternatively, a different solvent may be employed with at least a sufficient amount of carboxylic acid present, i.e. at least an equimolar amount based on the amount of perfluoroalkyl iodide, to satisfy the stoichiometry of equation 1. Useful solvents include those which are inert to the anodic oxidation process. Specific solvents include acetonitrile, nitromethane and methylene chloride. It is preferred to operate under essentially anhydrous conditions, but small quantities of water, e.g., up to about 2%, do not interfere with the coupling process. Larger quantities of water may lead to phase separation and/or dehydrofluorination.

It is preferred to employ a concentration of perfluoroalkyl iodide of 5 to 40 weight percent of the reaction mixture.

The anodic coupling process also requires the presence of a small amount of carboxylate ion, conveniently obtained by incorporation of an alkali metal salt of the carboxylic acid co-reactant in an amount to give, preferably, a 0.1M to 1.0M solution in the carboxylic acid.

The reaction temperature is not critical and temperatures of about room temperature up to the boiling point of the solvent at atmospheric pressure are conveniently employed, preferably 25°–150° C. Similarly reaction pressure is not critical, but it is preferred to employ pressures of atmospheric or below.

The process is conveniently carried out in an electrolysis cell. Suitable materials of cell construction include glass, nickel and nickel alloys, titanium, lead, polyethylene and polypropylene. Since neither starting material nor products are reducible at less negative potentials than that required for hydrogen evolution, it is not necessary to use a divided cell. It is preferred to use anode/cathode area ratio $>5$ to prevent reduction of $R_fI$ as a side reaction.

It is preferred to use as anode material platinum or palladium, most preferably platinum. Preferred cathode materials include those materials of low overvoltage for hydrogen evolution, e.g., platinum nickel, carbon and steel.

As depicted in equation (1), the iodide values are recovered in the form of alkyl iodides. Since these co-product iodides are also susceptible to iodine abstraction by alkyl radicals, it is desirable to remove them from the reaction mixture as rapidly as possible. Removal is conveniently accomplished by fractional distillation of $R^3I$ through a condenser cooled to a temperature intermediate between the boiling points of $R_f^1R_f^2CFI$ and $R^3I$ with subsequent condensation in a cold trap. Hence the perfluoroalkyl iodide starting material preferably has a boiling point at least 10° C higher than the alkyl iodide co-product. When reaction temperatures significantly below the boiling point of the solvent are employed, it is desirable to employ subatmospheric pressures to aid in removal of the alkyl iodide.

Since it is difficult to efficiently separate alkyl iodide co-product from relatively low boiling perfluoroalkyl iodides, it is preferred to employ perfluoroalkyl iodides which contain at least four carbon atoms as starting materials.

Electrolysis is conveniently carried out at a specified constant current density, achieved by application of an anode potential above the cricical potential at which the Kolbe reaction starts, generally in the range of 2.1–2.8 volts (normal hydrogen electrode). Electrolysis is continued until the pink color of the solution in the cell is discharged or until the perfluoroalkyl iodide has been consumed as determined by a suitable analytical technique such as gas-liquid partition chromatography. The fluorocarbon product generally separates, upon cooling, as a separate liquid or solid phase and the alkyl iodide co-product is recovered from the cold trap.

The perfluoroalkyl iodides employed as starting materials may be prepared by any of several well-known routes including oxidative decarboxylation of perfluoroalkanoic acids, by addition of the elements of "IF" (e.g., from $IF_5$) to perfluoroolefins, or by telomerization of lower perfluoroalkyl iodides with perfluoroolefins. These methods of synthesis and specific perfluoroalkyl iodides preparable by them are discussed by Lovelace, et al. in Aliphatic Fluorine Compounds, Reinhold Publishing Corporation, New York, 1958.

UTILITY

The fluorocarbon products of the invention are known to possess outstanding resistance to thermal and photochemical degradation because of the absence of carbon-hydrogen bonds. In addition they exhibit, generally, a low degree of mammalian toxicity. Such products are useful as thermally stable heat transfer fluids, dielectric fluids, lubricants in corrosive and high-temperature applications, as speciality plasticizers and as blood substitutes.

DESCRIPTION OF THE PREFERRED EMBODIMENTS

The following are illustrative examples of the invention in which all parts and percentages are by weight and all degrees are Centigrade unless otherwise stated. The conversions reported are calculated by the formula:

$$\% \text{ conversion} = \frac{\text{moles perfluoroalkyl iodide consumed}}{\text{moles perfluoroalkyl iodide charged}} \times 100$$

EXAMPLE 1

Coupling of Perfluorohexyl Iodide

A mixture of 8.0 g of anhydrous sodium acetate, 200 g of glacial acetic acid, 50 g of acetonitrile and 5.0 g of n-perfluorohexyl iodide was placed in a 3-necked undivided electrolysis cell equipped with two platinum wire electrodes. Current was passed at 270 mA while the cell temperature was maintained at 48°. After passage of 3500 coulombs of charge, the reaction mixture was analyzed by gas-liquid partition chromatography (glpc) on a ¼ inch × 10 feet column of 15% fluorosilicone (QF-1) on a diatomite support at 80°, 60 ml/min helium flow rate. The analysis showed that ~95% of the perfluorohexyl iodide had been consumed, and a new peak was observed. A fluffy white crystalline solid, formed during the electrolysis, was separated by filtration and it amounted to 0.24 g of n-perfluorododecane, mp 73°–75°; $^{19}F$ nmr spectrum was identical with that of an authentic sample.

EXAMPLE 2

A mixture of 3.0 g of anhydrous sodium acetate, 50.5 g of glacial acetic acid, and 10.28 g (0.023 mole) of perfluorohexyl iodide was placed in a 3-necked flask equipped with two platinum wire electrodes each of 2 $cm^2$ active area. A Dewar reflux condenser, cooled by refluxing trifluorotrichloroethane, was attached and it in turn was connected to a trap cooled at −78°. The solution was heated at reflux and current was passed at 540 mA until passage of 3582 coulombs of charge, at which point the solution was colorless. Glpc analysis showed <1% of perfluorohexyl iodide remained and quantities of white solid had separated. The reaction mixture was diluted with water and filtered to give 4.64 g of n-perfluorododecane, mp 73°–75°. Glpc analysis of the material in the trap showed the presence of 0.32 g of n-perfluorododecane with additional quantities of methyl iodide, $CF_3(CF_2)_5H$ (14% relative to methyl iodide by nmr analysis), and $CF_3(CF_2)_5CH_3$ (11% relative to methyl iodide by nmr analysis). Reaction of the trap material with a solution of 10 g of silver nitrate in 100 ml of methanol gave 5.42 g (0.023 mole; 100%) of precipitated silver iodide. The total yield of n-perfluorododecane product was 68% (99% conversion) at a current efficiency of 60%, based on equation (1).

EXAMPLE 3

A mixture of 2.0 g of anhydrous sodium acetate, 60 ml of glacial acetic acid and 10.70 g of n-perfluorohexyl iodide was placed in a 3-necked undivided electrolysis cell equipped with platinum wire electrodes and a reflex condenser, connected to a −78° trap. The cell was heated and the pressure was reduced so as to maintain a reflex temperature of 88°. Current was passed at 95–230 mA until the reaction mixture was colorless (2339 coulombs). The reaction mixture was diluted with trifluorotrichloroethane and 100 ml of water was added. The layers were separated, the aqueous layer washed with trifluorotrichloroethane, and the combined organic layers were dried over anhydrous magnesium sulfate. Glpc analysis showed the presence of 1.70 g of n-perfluorododecane. Glpc analysis of the contents of the −78° trap showed the presence of 8.26 g of recovered n-perfluorohexyl iodide. Thus a 90% yield of coupled product was realized at 22% conversion.

EXAMPLE 4

Ths example demonstrates the effect of the concentration of n-perfluorohexyl iodide in acetic acid on yield and current efficiency of coupled product. Electrolyses were carried out in a microcell equipped with two platinum wire electrodes and an air condensor leading to an nmr tube cooled in a Dry Ice/acetone mixture. Six ml of an acetic acid solution, 1.0 M in sodium acetate, were placed in the cell, and varying amounts of n-perfluorohexyl iodide were added. The solution was heated at reflex and electrolysis was carried out at 200 mA until the iodine color had disappeared. Yields of coupled product, n-perfluorododecane, were calculated from glpc analysis of a trifluorotrichloroethane extract of the reaction mixture. Yields of volatile products were determined by nmr analysis of the material collected in the Dry Ice/acetone-cooled trap after addition of benzene as an internal standard. The results of these experiments are summarized in Table I.

Table I

| Ex. | Perfluorohexyl Iodide ($R_fI$) Conc., (wt.%) | Yield $R_fR_f$ (%) | Yield $R_fH$ (%) | Yield $R_fCH_3$ (%) | Current Efficiency at 90% Conversion |
|---|---|---|---|---|---|
| 4A | 37 | 53 | 22 | 5 | 78 |
| 4B | 22 | 62 | 15 | 10 | 65 |
| 4C | 13 | 33 | 12 | 12 | 32 |
| 4D | 4.4 | 15 | 8 | 22 | 32 |

EXAMPLES 5-15

Electrolyses were carried out in a solution of glacial acetic acid, 1.0M in sodium acetate, at reflex temperature until the iodine color had disappeared. The products were analyzed by glpc and/or nmr analysis in the usual way to obtain yields of coupled products, $R_fR_f$, $R_fH$ and $R_fCH_3$, and the results are tabulated in Table II.

Table II

| Example | Perfluoroalkyl Iodide, $R_fI$ | Wt. $R_fI$(g) | Conc. $R_fI$(%) | Current Density (mA) | Conversion % | Yield $R_fR_f$(%) | Yield $R_fH$(%) | Yield $R_fCH_3$(%) |
|---|---|---|---|---|---|---|---|---|
| 5 | $CF_3(CF_2)_3I$ | 40.82 | 37 | — | 62 | 62 | 18 | 11 |
| 6 | $CF_3(CF_2)_3I$ | 10.04 | — | 540 | 58 | 90 | 5 | 3 |
| 7 | $CF_3(CF_2)_4I$ | 41.71[1] | — | — | 65 | 61 | 16 | 10 |
| 8 | $CF_3(CF_2)_3I$ | 20.45[1] | | | | | | |
| | $CF_3(CF_2)_4I$ | 21.46 | — | 650 | 58 | 63[2] | 17 | 12 |
| 9 | $CF_3(CF_2)_6I$ | 1.46 | 17 | 270 | 97 | 73 | 15 | 5 |
| 10 | $CF_3(CF_2)_9I$ | 1.18 | 14[3] | — | 93 | 55 | 18 | 15 |
| 11 | $(CF_3)_2CF(CF_2CF_2)_nI$[4] | 8.6 | 12 | 270 | 98 | 52[5] | — | — |
| 12 | $CF_3(CF_2)_2CFICF_3$ | 1.80 | — | 270 | 50 | 33 | 15 | 10 |
| 13 | $CF_3(CF_2)_3CFICF_3$ | 2.35 | 25 | 200 | 60 | 65 | 16 | 9 |
| 14 | $CF_3(CF_2)_4CFICF_3$ | 2.40 | 26 | 270 | 95 | 75 | 15 | 8 |
| 15 | $CF_3(CF_2)_kCFICF_3$[6] | 2.61 | 27 | 270 | >99 | 75[7] | 11 | 14 |

[1] $R_fI$ was added gradually from a dropping funnel during the electrolysis.
[2] Coupled product was a mixture of $C_8F_{18}$, $C_9F_{20}$ and $C_{10}F_{22}$ in a 1:5:4 ratio.
[3] Two layers were present during the electrolysis.
[4] n = 0-8; mixture obtained from telomerization of $(CF_3)_2CFI$ with tetrafluoroethylene.
[5] The product was a complex mixture of fluorocarbons.
[6] k = 3, 5, 7
[7] The product was a mixture of fluorocarbons.

I claim:

1. A process of preparing perfluoroalkanes comprising anodically coupling at least one compound of the formula $R_f^1R_f^2CFI$ wherein $R_f^1$ and $R_f^2$ are each independently fluorine or a perfluoroalkyl radical containing from 4 to 40 carbon atoms in a liquid carboxylic acid in the presence of a small amount of carboxylate ion.

2. The process of claim 1 wherein the temperature is from about 25° C to about 150° C.

3. The process of claim 2 wherein there is present less than about 2 weight percent water.

4. The process of claim 3 wherein the concentration of $R_f^1R_f^2CFI$ in the reaction mixture is from 5 to 40 weight percent of the reaction mixture.

5. The process of claim 4 wherein the liquid carboxylic acid is a straight chain carboxylic acid of the formula RCOOH or $R_fCOOH$ wherein R is an alkyl group of from 1 to 4 carbon atoms and $R_f$ is perfluoroalkyl group of from 1 to 4 carbon atoms.

6. The process of claim 5 wherein $R_f^1$ is fluorine.

7. The process of claim 6 wherein $R_f^2$ is a perfluoroalkyl group containing from 5 to 8 carbon atoms.

8. The process of claim 7 wherein the liquid carboxylic acid is acetic acid.

9. The process of claim 8 wherein the carboxylate ion is supplied by from 0.1M to 1.0M of an alkali metal salt of a carboxylic acid.

10. The process of claim 9 wherein the alkali metal salt of a carboxylic acid is sodium acetate.

* * * * *